US010504401B2

(12) United States Patent
Hsu et al.

(10) Patent No.: US 10,504,401 B2
(45) Date of Patent: Dec. 10, 2019

(54) DISPLAY PANEL

(71) Applicant: Au Optronics Corporation, Hsinchu (TW)

(72) Inventors: Wei-Chu Hsu, Taipei (TW); Ko-Ruey Jen, Taipei (TW)

(73) Assignee: Au Optronics Corporation, Hsinchu (TW)

( * ) Notice: Subject to any disclaimer, the term of this patent is extended or adjusted under 35 U.S.C. 154(b) by 21 days.

(21) Appl. No.: 16/029,652

(22) Filed: Jul. 9, 2018

(65) Prior Publication Data

US 2019/0189043 A1 Jun. 20, 2019

(30) Foreign Application Priority Data

Dec. 18, 2017 (TW) ..... 106144363 A

(51) Int. Cl.
*G09G 5/02* (2006.01)
*G09G 3/20* (2006.01)
*G09G 3/3258* (2016.01)

(52) U.S. Cl.
CPC ..... *G09G 3/2003* (2013.01); *G09G 3/3258* (2013.01); *G09G 2300/0804* (2013.01); *G09G 2310/08* (2013.01); *G09G 2320/0666* (2013.01)

(58) Field of Classification Search
CPC ..... G09G 3/2003; G09G 3/3258; G09G 2300/0804; G09G 2310/08
USPC ..... 345/694
See application file for complete search history.

(56) References Cited

U.S. PATENT DOCUMENTS

| | | | | |
|---|---|---|---|---|
| 6,404,414 | B2 | 6/2002 | Ishii | |
| 7,164,408 | B2 | 1/2007 | Murade | |
| 8,289,234 | B2 | 10/2012 | Kim | |
| 2002/0047822 | A1* | 4/2002 | Senda | G09G 3/32 345/90 |
| 2004/0119075 | A1* | 6/2004 | Murade | G02F 1/136227 257/72 |
| 2007/0040770 | A1 | 2/2007 | Kim | |
| 2009/0231363 | A1* | 9/2009 | Liu | G09G 3/3688 345/690 |
| 2015/0255030 | A1* | 9/2015 | Watsuda | G09G 3/3648 345/92 |

(Continued)

FOREIGN PATENT DOCUMENTS

| | | |
|---|---|---|
| CN | 1494050 | 5/2004 |
| CN | 1917015 | 2/2007 |

*Primary Examiner* — Jonathan M Blancha
(74) *Attorney, Agent, or Firm* — JCIPRNET

(57) ABSTRACT

A display panel is provided. A pixel array includes a plurality of first subpixels, a first source line coupled to the first subpixels, a plurality of second subpixels displaying the same with the first subpixels, and a second source line coupled to the second subpixels. A multiplexer circuit includes a first switch coupled between the first source line and a source driver and a second switch coupled between the second source line and the source driver. A first compensation capacitor couples between the first source line and a reference voltage, and a capacitance value thereof is related to a cut-off time point of the first switch. A second compensation capacitor couples between the second source line and the reference voltage, and a capacitance value thereof the second compensation capacitor is related to a cut-off time point of the second switch different from the cut-off time point of the second switch.

9 Claims, 4 Drawing Sheets

(56) References Cited

U.S. PATENT DOCUMENTS

2015/0287378 A1* 10/2015 Jeong ..... G09G 3/3688
345/694
2016/0007011 A1* 1/2016 Nonaka ..... H04N 13/359
348/59

* cited by examiner

DISPLAY PANEL

CROSS-REFERENCE TO RELATED APPLICATION

This application claims the priority benefit of Taiwan application serial no. 106144363, filed on Dec. 18, 2017. The entirety of the above-mentioned patent application is hereby incorporated by reference herein and made a part of this specification.

BACKGROUND OF THE INVENTION

1. Field of the Invention

The invention relates to a display technology. More particularly, the invention relates to a display panel.

2. Description of Related Art

In the existing display technology, a source driver commonly transmits a pixel voltage to a pixel through a multiplexer, so as to reduce a number of data channels in the source driver most of the time.

Nevertheless, in the multiplexer, if the ratio for the subpixels being driven exceeds 1:4, the pixel voltage being transmitted may be affected. Voltages of the subpixels driven by the multiplexer to display the same color light are thereby inconsistent, and bright lines and dark lines may thus appear on the display panel.

SUMMARY OF THE INVENTION

The invention provides a display panel which may suppress bright lines and dark lights to appear on the display panel by using compensation capacitors.

In an embodiment of the invention, a display panel includes a pixel array, a multiplexer circuit, a first compensation capacitor, and a second compensation capacitor. The pixel array includes a plurality of first subpixels, first source lines coupled to the first subpixels, a plurality of second subpixels displaying a same color light as the first subpixels, and second source lines coupled to the second subpixels. The multiplexer circuit includes a first switch coupled between the first source lines and a source driver and a second switch coupled between the second source lines and the source driver. A first compensation capacitor is coupled between the first source line and a reference voltage. A capacitance value of the first compensation capacitor is related to a cut-off time point of the first switch. A second compensation capacitor is coupled between the second source line and the reference voltage. A capacitance value of the second compensation capacitor is related to a cut-off time point of the second switch. The cut-off time point of the first switch is different from the cut-off time point of the second switch.

To sum up, in the display panel of the embodiments of the invention, the values of the compensation capacitors of the subpixels using the same multiplexer and displaying the same color are designed to be different. Relationship between capacitance values of the compensation capacitors corresponding to the subpixels is contrary to a turning-on order in the corresponding multiplexer, and therefore, the bright lines and the dark lines can be suppressed to appear on the display panel.

To make the aforementioned and other features and advantages of the invention more comprehensible, several embodiments accompanied with drawings are described in detail as follows.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
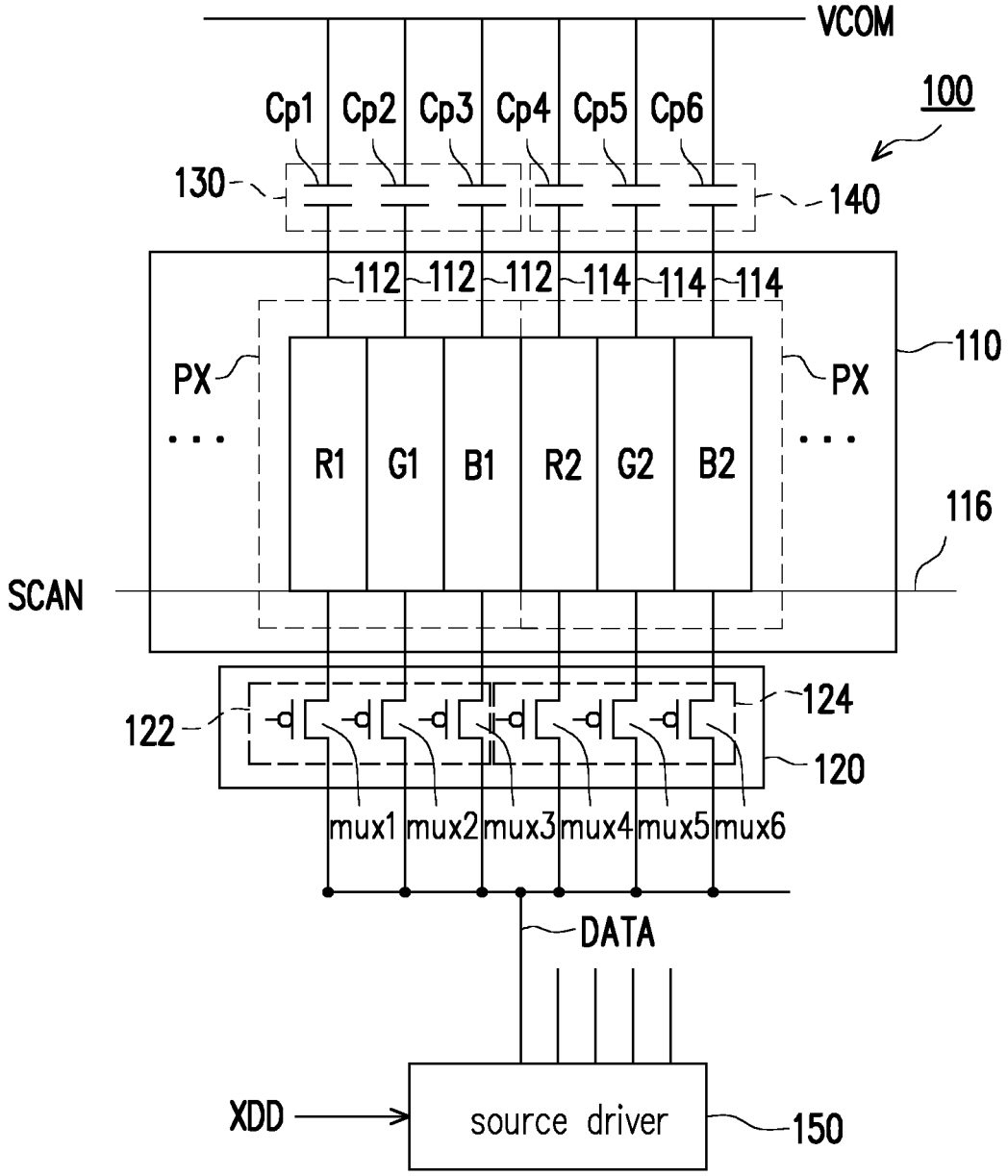
FIG. 1 is a schematic diagram of a structure of a display panel according to an embodiment of the invention.

Reference will now be made in detail to the present preferred embodiments of the disclosure, examples of which are illustrated in the accompanying drawings. Wherever possible, the same reference numbers are used in the drawings and the description to refer to the same or like parts.

FIG. 1 is a schematic diagram of a structure of a display panel according to an embodiment of the invention. With reference to FIG. 1, a display panel 100 includes a pixel array 110, a multiplexer circuit 120, a first compensation capacitor unit 130, a second compensation capacitor unit 140. The display panel 100 further includes a source driver 150. The source driver 150 is disposed on the display panel 100 in this embodiment, but the source driver 150 may also be disposed on a circuit board (e.g., a flexible circuit board (FPC)) coupled to the display panel 100 in other embodiments.

The pixel array 110 includes a plurality of pixels PX arranged in an array, a plurality of first source lines 112, a plurality of second source lines 114, and a plurality of gate lines 116. Moreover, FIG. 1 is exemplary only, and in fact, numbers of the pixels PX, the first source lines 112, the second source lines 114, and the gate lines 116 are not limited. That is, the numbers of the pixels PX, the first source lines 112, the second source lines 114, and the gate lines 116 are integers of 2 or greater than 2. Each of the pixels PX is coupled to the corresponding source line (e.g., as shown by 112 or 114) and the corresponding gate line 116 for receiving a corresponding scan signal SCAN. Each of the pixels PX further includes a plurality of subpixels. For instance, the pixel PX on the left includes a plurality of first subpixels R1, G1, and B1, and the pixel PX on the right includes a plurality of second subpixels R2, G2, and B2. The pixels PX are configured to respectively display color lights of red, green, and blue. The first source lines 112 are coupled to the first subpixels R1, G1, and B1, and the second source lines 114 are coupled to the second subpixels R2, G2, and B2. A number of the subpixels of each of the pixels PX is three in this embodiment, but the number of the subpixels of each of the pixels is not limited to the above in other embodiments.

To be specific, the subpixel R1 and the subpixel R2 are configured to display a same red color light, the subpixel G1 and the subpixel G2 are configured to display a same green color light, and the subpixel B1 and the subpixel B2 are configured to display a same blue color light. The same color light, for example, has a central wavelength (color) identical to a brightness in the color light emitted. That is, light emitting elements of the subpixels configured to display the same color light are substantially identical. For instance, the light emitting elements of the subpixel R1 and the subpixel R2 are substantially identical.

The first compensation capacitor unit 130 is coupled between the first source lines 112 and a reference voltage (e.g., a common voltage VCOM), and the second compensation capacitor unit 140 is coupled between the second source lines 114 and the reference voltage (e.g., the common voltage VCOM). Herein, the first compensation capacitor unit 130 and the second compensation capacitor unit 140 may be disposed outside the pixel array 110. For instance, the first compensation capacitor unit 130 and the second compensation capacitor unit 140 may be disposed at the other side of the pixel array 110 opposite to the source driver 150. The first compensation capacitor unit 130 includes first compensation capacitors Cp1, Cp2, and Cp3 respectively coupled to the first subpixels R1, G1, and B1, and the second compensation capacitor unit 140 includes second compensation capacitors Cp4, Cp5, and Cp6 respectively coupled to the second subpixels R2, G2, and B2. In this embodiment, the first compensation capacitors Cp1, Cp2, and Cp3 and the second compensation capacitors Cp4, Cp5, and Cp6 are configured for voltage compensation (which is described in the following) for different compensation times of the subpixels (e.g., R1, G1, B1, R2, G2, and B2). In other words, in the subpixels (e.g., the first subpixel G1 and the second subpixel G2) corresponding to the same color, a capacitance value of the first compensation capacitor (e.g., Cp2) is different from a capacitance value of the second compensation capacitor (e.g., Cp5).

The multiplexer circuit 120 includes a first switch unit 122 and a second switch unit 124. The first switch unit 122 is coupled to first terminals of the first source lines 112, the first compensation capacitor unit 130 is coupled to second terminals of the first source lines 112, the second switch unit 124 is coupled to first terminals of the second source lines 114, and the second compensation capacitor unit 140 is coupled to second terminals of the second source lines 114.

In this embodiment, the multiplexer circuit 120 is coupled between the pixel array 110 and the source driver 150. The source driver 150 is, for example, coupled to a sequence controller (not shown) so as to generate a data voltage DATA according to a display data XDD provided by the sequence controller, and the multiplexer circuit 120 transmits the data voltage DATA to the pixel array 110. To be specific, the first switch unit 122 is coupled between the first source lines 112 and the source driver 150, and the second switch unit 124 is coupled between the second source lines 114 and the source driver 150. The first switch unit 122 includes a plurality of first switches mux1, mux2, and mux3, and the first switches mux1, mux2, and mux3 are coupled between the first subpixels R1, G1, and B1 and the source driver 150 respectively through the first source lines 112. In other words, the first switch mux1 may transmit the data voltage DATA generated by the source driver 150 to the first subpixel R1 to drive the first subpixel R1, the first switch mux2 may transmit the data voltage DATA to the first subpixel G1 to drive the first subpixel G1, and the first switch mux3 may transmit the data voltage DATA to the first subpixel B1 to drive the first subpixel B1. In another aspect, the second switch unit 124 also includes a plurality of second switches mux4, mux5, and mux6 having functions similar to that of the first switches mux1, mux2, and mux3, and the second switches mux4, mux5, and mux6 are configured to respectively drive the second subpixels R2, G2, and B2. The first switches mux1, mux2, and mux3 and the second switches mux4, mux5, and mux6 are commonly coupled to the source driver 150 for receiving the same data voltage DATA. That is, at most one of the first switches mux1, mux2, and mux3 and the second switches mux4, mux5, and mux6 is turned on at the same time.

The first switches mux1, mux2, and mux3 and the second switches mux4, mux5, and mux6 are implemented as switch transistors in this embodiment, for example, by using p-channel transistors (PMOS), but the invention is not limited to the above. The switches may also be implemented through n-channel transistors (NMOS) or complementary transistors (CMOS) in other embodiments. Adequate adjustments may be made by people having ordinary skills in the art according to the foregoing embodiments and the common knowledge based on actual requirements. Details are not repeated hereinafter.

In this embodiment, the capacitance value of the first compensation capacitor and the capacitance value of the second compensation capacitor of the subpixels emitting the same color light are related to cut-off times of the corresponding switches. For instance, the first compensation capacitor Cp1 and the second compensation capacitor Cp4 respectively correspond to the first subpixel R1 and the second subpixel R2 emitting the same color light. Moreover, the capacitance value of the first compensation capacitor Cp1 is related to a cut-off time point of the corresponding first switch mux1, and the capacitance value of the second compensation capacitor Cp4 is related to a cut-off time point of the second switch mux4. The cut-off time point of the first switch mux1 is different from the cut-off time point of the second switch mux4, and thereby, the capacitance value of the first compensation capacitor Cp1 and the capacitance value of the second compensation capacitor Cp4 are different. By analogy, the capacitance value of the first compensation capacitor Cp2 and the capacitance value of the second compensation capacitor Cp5 respectively corresponding to the first subpixel G1 and the second subpixel G2 are different, and the capacitance value of the first compensation capacitor Cp3 and the capacitance value of the second compensation capacitor Cp6 respectively corresponding to the first subpixel B1 and the second subpixel B2 are different either. To be Specific, relative relationship between the capacitance value of the first compensation capacitor and the capacitance value of the second compensation capacitor corresponding to the subpixels emitting the same color light is contrary to an order of turning off (cutting off) the switches (e.g., mux1 to mux6) in the first switch unit 122 and the second switch unit 124. Details are provided in the following.

Figure 2:
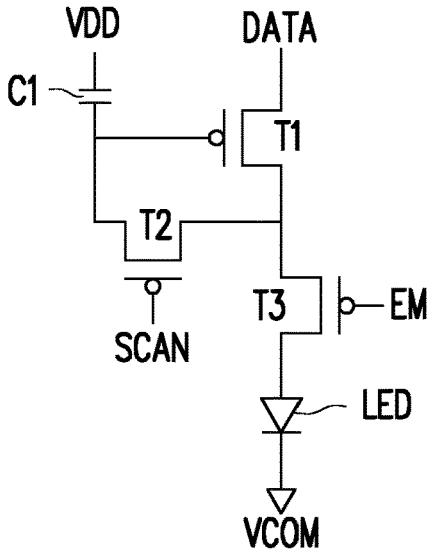
FIG. 2 is a diagram of a circuit structure of a subpixel according to an embodiment of the invention.

FIG. 2 is a diagram of a circuit structure of a subpixel according to an embodiment of the invention. With reference to FIG. 1 and FIG. 2, the circuit structure of the subpixel of FIG. 2 is suitable for any subpixel on the display panel 100, for example, any one from the first subpixels R1, G1, and B1 and the second subpixels R2, G2, and B2. In this embodiment, each of the first subpixels R1, G1, and B1 and the second subpixels R2, G2, and B2 includes a first transistor T1, a second transistor T2, a third transistor T3, a first capacitor C1, and a light emitting diode LED. In this embodiment, the light emitting diode LED is an organic light emitting diode or an micro-light emitting diode (uLED), and the first transistor T1, the second transistor T2, and the third transistor T3 are implemented as the p-channel transistors. Nevertheless, the invention is not limited to the above. In some embodiments, the first transistor T1, the second transistor T2, and the third transistor T3 may be the n-channel transistors (NMOS), and the light emitting diode LED may be an organic light emitting diode (OLED), an inorganic light emitting diode (LED), or other solid-state light emitting elements. Adequate adjustments may be made by people having ordinary skills in the art according to the embodiments and the common knowledge based on actual requirements.

In this embodiment, a source terminal of the first transistor T1 is coupled to a first voltage, and the first capacitor C1 is coupled between a second voltage and a gate terminal of the first transistor T1. One of the first voltage and the second voltage is the data voltage DATA transmitted by the first source lines 112 or the second source lines 114, and the other one of the first voltage and the second voltage is a system voltage VDD different from the common voltage VCOM. The first voltage is the data voltage DATA and the second voltage is the system voltage VDD in this embodiment.

The first transistor T1 provides a driving current to the light emitting diode LED in this embodiment. A source terminal of the second transistor T2 is coupled to a drain terminal of the first transistor T1, a drain terminal of the second transistor T2 is coupled to the gate terminal of the first transistor T1, and a gate terminal of the second transistor T2 is configured to receive the scan signal SCAN. Moreover, the second transistor T2 is controlled by the scan signal SCAN to be turned on or cut off. The third transistor T3 has a source terminal coupled to the drain terminal of the first transistor T1, and a gate terminal of the third transistor T3 receives a light emitting signal EM, wherein the third transistor T3 is controlled by the light emitting signal EM to be turned on or cut off. The light emitting diode LED is coupled between a drain terminal of the third transistor T3 and the common voltage VCOM and determines whether to receive the driving current from the first transistor T1 to emit light according to the turn-on or cut-off state of the third transistor T3.

Figure 3:
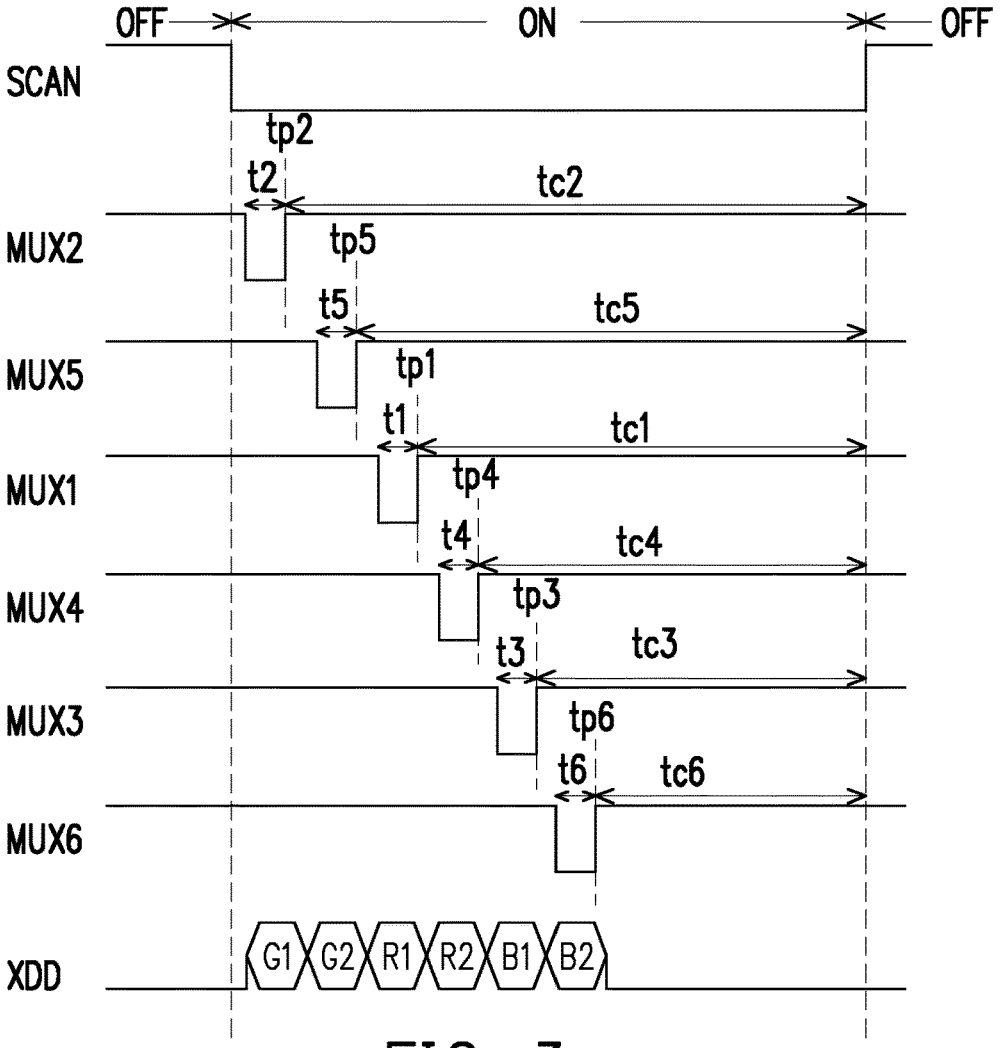
FIG. 3 is a schematic diagram of operation waveforms of a circuit structure of a subpixel according to an embodiment of the invention.

FIG. 3 is a schematic diagram of operation waveforms of a circuit structure of a subpixel according to an embodiment of the invention. With reference to FIG. 1, FIG. 2, and FIG. 3, in the subpixels R1, G1, B1, R2, B2, and G2, the second transistor T2 is controlled by the scan signal SCAN to be turned on or cut off. The switches mux1, mux2, mux3, mux4, mux5, and mux6 in the multiplexer circuit 120 respectively receive switch signals MUX1, MUX2, MUX3, MUX4, MUX5, and MUX6 to be turned on or cut off. The subpixels R1, G1, B1, R2, B2, and G2 display according to the data voltage DATA received.

In this embodiment, in a cut-off state period OFF, the scan signal SCAN is a disabling level (e.g., a high level), and the second transistor T2 is in the cut-off state at this time. In a horizontal scan period ON, the scan signal SCAN is an enabling level (e.g., a low level), and the second transistor T2 is in the turned-on state at this time. Moreover, the switches mux1, mux2, mux3, mux4, mux5, and mux6 are turned on in sequence in the horizontal scan period ON. To be specific, the switch signals MUX1, MUX2, MUX3, MUX4, MUX5, and MUX6 are enabled in sequence (e.g., as shown by enabling periods t1, t2, t3, t4, t5, and t6), as such, the switches mux1, mux2, mux3, mux4, mux5, and mux6 in the multiplexer circuit 120 are turned on in sequence in the horizontal scan period ON, and that the subpixels R1, G1, B1, R2, B2, and G2 respectively receive the corresponding data voltages DATA.

In this embodiment, the subpixels are assumed to be written in an order of G1, G2, R1, R2, B1, and followed by the last one B2. When the scan signal SCAN is enabled (i.e., the horizontal scan period ON), the first switch mux2 corresponding to the subpixel G1 is first turned on in the enabling period t2, such that the subpixel G1 receives the data voltage DATA to be displayed. After the enabling period t2 is over, the first switch mux2 is turned off at a cut-off time point tp2. Next, the second switch mux5 corresponding to the subpixel G2 is turned on in the enabling period t5 and is turned off at a cut-off time point tp5, and the rest may be deduced by analogy. The first switch mux1, the second switch mux4, the first switch mux3, and the second switch mux6 are turned on successively in the enabling periods t1, t4, t3, and t6 and are cut off at cut-off time points tp1, tp4, tp3, and tp6. In other words, the cut-off time points of the first switch and the second switch in the subpixels corresponding to the same color light are different. In this embodiment, the cut-off time points of the first switch mux1, mux2, and mux3 and the cut-off time points of the second switches mux4, mux5, and mux6 are all different.

As described above, the cut-off time points tp1, tp2, and tp3 of the first switches mux1, mux2, and mux3 are prior to the corresponding cut-off time points tp4, tp5, and tp6 of the second switches mux4, mux5, and mux6. As such, first compensation times tc1, tc2, and tc3 during which the first subpixels R1, G1, and B1 are charged by the first source lines 112 are respectively greater than second compensation times tc4, tc5, and tc6 during which the second subpixels R2, G2, and B2 are charged by the second source lines 114. The first compensation times tc1, tc2, and tc3 respectively range between the cut-off time points tp1, tp2, and tp3 and a cut-off time point of the horizontal scan period ON (i.e., a time point of a corresponding rising edge in the scan signal SCAN). The second compensation times tc4, tc5, and tc6 range between the cut-off time points tp4, tp5, and tp6 and the cut-off time point of the horizontal scan period ON.

Figure 4:
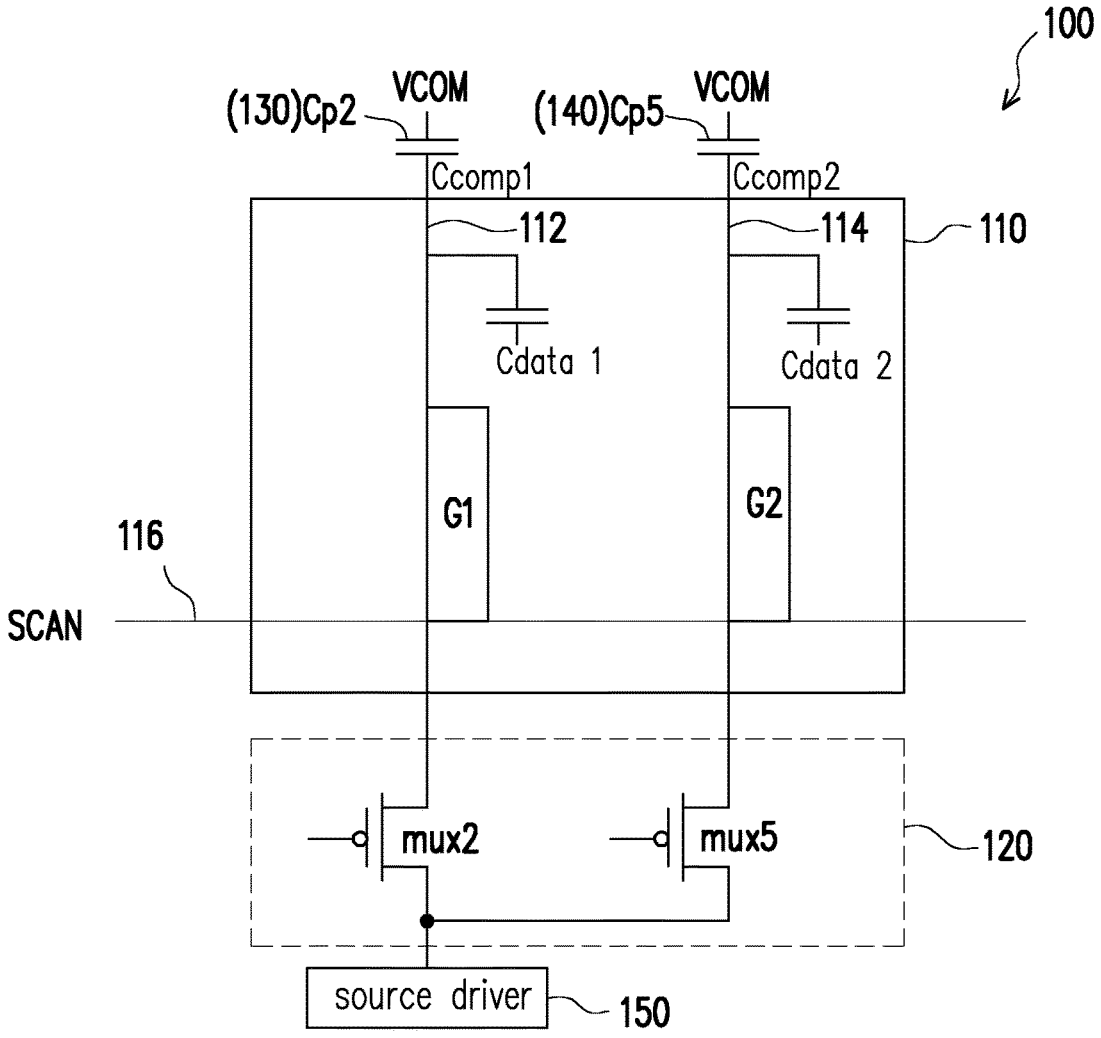
FIG. 4 is a schematic diagram illustrating a portion of a structure of a display panel according to an embodiment of the invention.

FIG. 4 is a schematic diagram illustrating a portion of a structure of a display panel according to an embodiment of the invention. Further, FIG. 4 is a schematic diagram of a portion of a structure of the display panel 100. For ease of explanation, FIG. 4 only illustrates portions related to the subpixel G1 and the subpixel G2. Other portions of the subpixels are ignored, but the relations between the subpixels displaying the same color light may be deduced by analogy, a relevant description thereof is thus omitted. With reference to FIG. 1 to FIG. 4 together.

In this embodiment, after the first switch mux2 is cut off at the cut-off time point tp2, in the first compensation time tc2, the first capacitor C1 in the subpixel G1 continues to be charged due to a charge existing in an equivalent capacitor (e.g., Cdata1 shown in FIG. 4) of the first source line 112. After the second switch mux5 is cut off at the cut-off time point tp5, in the second compensation time tc5, the first capacitor C1 in the subpixel G2 continues to be charged as well due to a charge existing in an equivalent capacitor (e.g., Cdata2 shown in FIG. 4) of the second source line 114.

Figure 5:
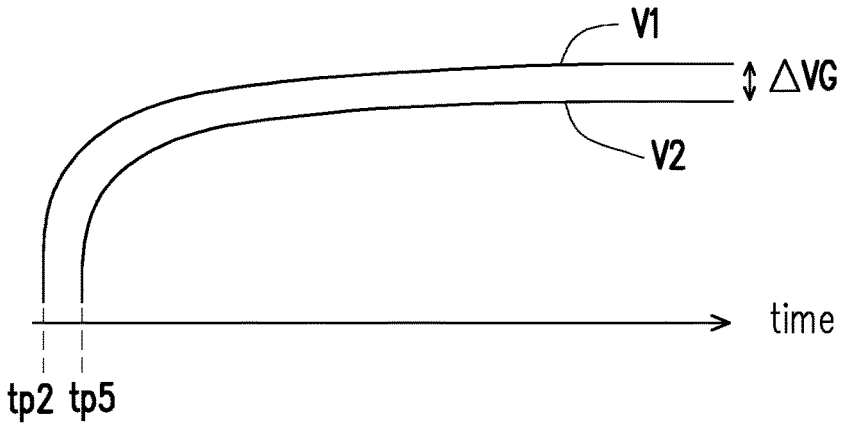
FIG. 5 is a schematic chart illustrating changes of voltages over time of a circuit structure of a subpixel without a compensation capacitor.

FIG. 5 is a schematic chart illustrating changes of voltages over time of a circuit structure of a subpixel without a compensation capacitor. With reference to FIG. 4 and FIG. 5, in a display panel without a compensation capacitor (i.e., without the first compensation capacitor unit 130 nor the second compensation capacitor unit 140 in FIG. 1), after the first switch mux2 is cut off at the cut-off time point tp2, the first capacitor C1 in the subpixel G1 continues to be charged in the first compensation time tc2, and a voltage variation curve thereof is as shown by a curve V1; a voltage variation curve of the first capacitor C1 in the subpixel G2 in the first compensation time tc5 is as shown by a curve V2. Since the cut-off time point tp2 is prior to the cut-off time point tp5, durations of time during which the respective first capacitors C1 of the subpixel G1 and the subpixel G2 are charged are different (the first compensation time tc2 is greater than the second compensation time tc5). Therefore, a voltage difference ΔVG therebetween exists, and the voltage difference ΔVG may lead to aberration in the color lights displayed by the subpixel G1 and the subpixel G2, meaning that the brightnesses of the same color lights are different.

With reference to FIG. 1 again, in this embodiment, the capacitance value of the first compensation capacitor Cp1, Cp2, or Cp3 is related to the corresponding one of the cut-off time points tp1, tp2, and tp3 of the first switches mux1, mux2, and mux3, and the capacitance value of the second compensation capacitor Cp4, Cp5, or Cp6 is related to the corresponding one of the cut-off time points tp4, tp5, and tp6 of the second switches mux4, mux5, and mux6. Moreover, the cut-off time points tp1, tp2, and tp3 of the first switches mux1, mux2, and mux3 are respectively prior to the cut-off time points tp4, tp5, and tp6 of the second switches mux4, mux5, and mux6. As such, the capacitance values of the first compensation capacitors Cp1, Cp2, and Cp3 are respectively less than the corresponding capacitance values in the second compensation capacitors Cp4, Cp5, and Cp6, so as to balance differences generated by different compensation times (charging times after the data voltage DATA is written).

To be specific, as shown by the embodiment of FIG. 4, the cut-off time point tp2 corresponding to the first switch mux2 is prior to the cut-off time point tp5 corresponding to the second switch mux5. Moreover, a capacitance value Ccomp1 of the first compensation capacitor Cp2 is designed to be less than a capacitance value Ccomp2 of the second compensation capacitor Cp5. In an embodiment, the capacitance value Ccomp1 may be designed to be 1 fF (femtofarad), and the capacitance value Ccomp2 may be designed to be 400 fF. Note that in an embodiment, the capacitance values of the compensation capacitors of the subpixels belonging to the same pixel PX may be identical. For instance, the first compensation capacitors Cp1 and Cp3 corresponding to the subpixels R1 and B1 may be designed to have the same capacitance value Ccomp1, and the second compensation capacitors Cp4 and Cp6 corresponding to the subpixels R2 and B2 may be designed to have the same capacitance value Ccomp2. In another embodiment, the capacitance values of the compensation capacitors of the subpixels belonging to the same pixel PX may be different, and the invention is not limited to the above.

Figures 6A, 6B:
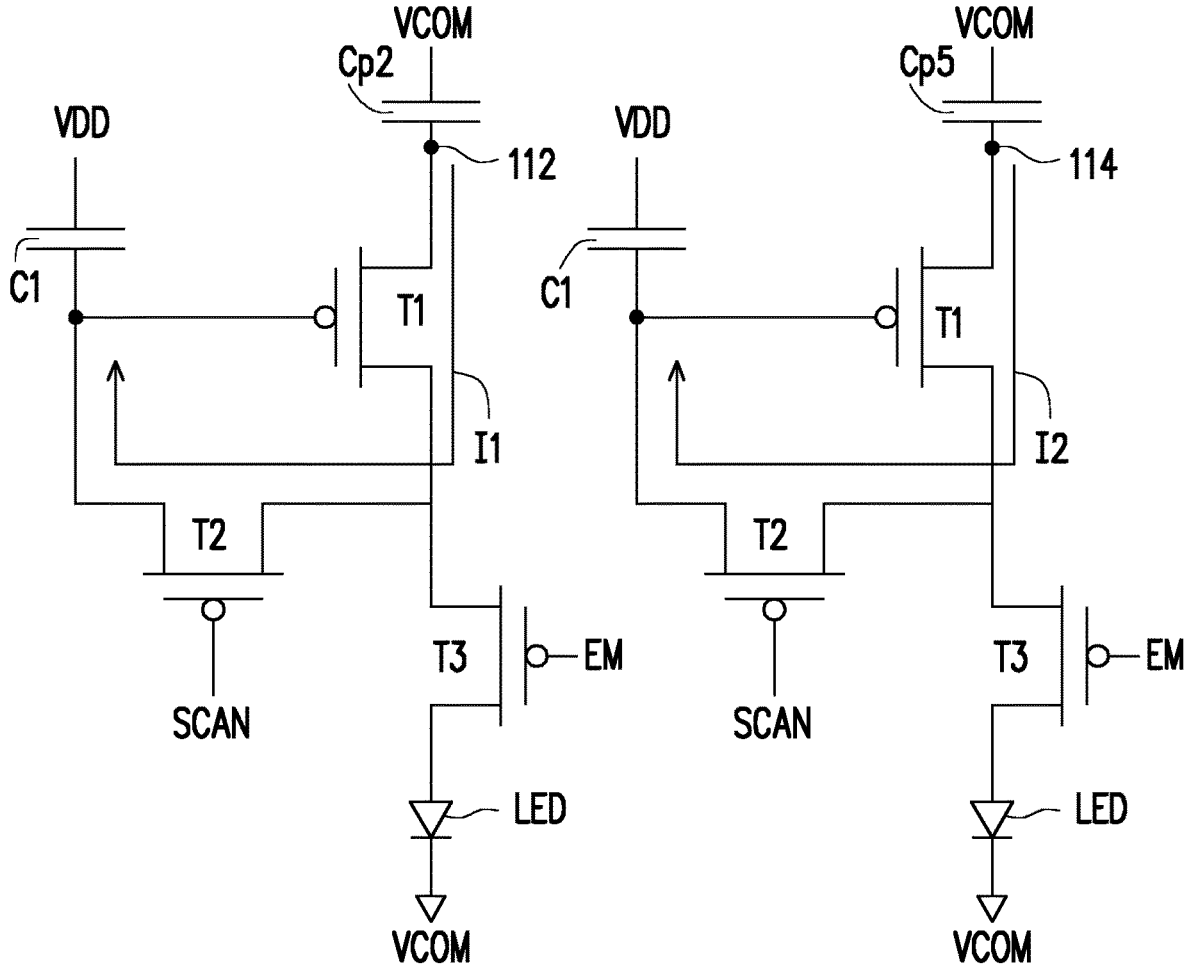
FIG. 6A and FIG. 6B are schematic diagrams respectively illustrating circuit structures of two subpixels emitting a same color light according to an embodiment of the invention.

FIG. 6A and FIG. 6B are schematic diagrams respectively illustrating circuit structures of two subpixels emitting a same color light according to an embodiment of the invention. With reference to FIG. 6A and FIG. 6B, FIG. 6A is, for example, a schematic diagram of a circuit structure of the subpixel G1, and FIG. 6B is, for example, a schematic diagram of a circuit structure of the subpixel G2. In the first compensation time tc2, the first transistor T1 and the second transistor T2 of the subpixel G1 are turned on, and the third transistor T3 of the subpixel G1 is cut off. At this time, the first compensation capacitor Cp2 is discharged, and a charging current I1 reaches one end of the capacitor C1 through the first transistor T1 and the second transistor T2. Similarly, in the second compensation time tc5, the first transistor T1 and the second transistor T2 of the subpixel G2 are turned on, and the third transistor T3 of the subpixel G2 is cut off. At this time, the second compensation capacitor Cp5 is discharged, and a charging current I2 reaches one end of the capacitor C1 through the first transistor T1 and the second transistor T2. Moreover, the second compensation time tc5 is less than the first compensation time tc2. Nevertheless, in order to enable the capacitors C1 of the subpixels G1 and G2 reach the same charging effect, meaning that identical charges are stored under the same gray level value, the capacitance value Ccomp2 of the second compensation capacitor Cp5 may be designed to be greater than the capacitance value Ccomp1 of the first compensation capacitor Cp2. As such, the current I2 is greater than the current I1, and that the charging effect of the capacitor C1 of the subpixel G2 is identical to or similar to the charging effect of the capacitor C1 of the subpixel G1.

In view of the foregoing, in the display panel provided by an embodiment of the invention, since the compensation capacitors are coupled to the source lines, voltage compensation is made to the subpixels displaying the same color and coupled to the same multiplexer circuit. The values of the capacitance values of the compensation capacitors are related to the compensation times of the subpixels displaying the same color. That is, the compensation capacitor corresponding to the multiplexer being activated earlier is less than the compensation capacitor corresponding to the multiplexer being activated later. Therefore, the bright lines and the dark lines may be suppressed to appear on the display panel.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A display panel, comprising:

a pixel array, comprising:

a plurality of first subpixels;

a first source line, coupled to the first subpixels;

a plurality of second subpixels, displaying a same color light as the first subpixels; and a second source line, coupled to the second subpixels;

a multiplexer circuit, comprising:

a first switch, coupled between the first source line and a source driver; and a second switch, coupled between the second source line and the source driver;

a first compensation capacitor, coupled between the first source line and a reference voltage, wherein a capacitance value of the first compensation capacitor is related to a cut-off time point of the first switch; and a second compensation capacitor, coupled between the second source line and the reference voltage, wherein a capacitance value of the second compensation capacitor is related to a cut-off time point of the second switch, wherein the cut-off time point of the first switch is different from the cut-off time point of the second switch.

2. The display panel as claimed in claim 1, wherein the first switch and the second switch are turned on in sequence in a horizontal scan period.

3. The display panel as claimed in claim 2, wherein in the horizontal scan period, the cut-off time point of the first switch is prior to the cut-off time point of the second switch, and the capacitance value of the first compensation capacitor is less than the capacitance value of the second compensation capacitor.

4. The display panel as claimed in claim 3, wherein a first compensation time for the first subpixels by the first source line is greater than a second compensation time for the second subpixels by the second source line such that the capacitance value of the first compensation capacitor is less than the capacitance value of the second compensation capacitor.

5. The display panel as claimed in claim 4, wherein the first compensation time ranges between the cut-off time point of the first switch and a cut-off time point of the horizontal scan period, and the second compensation time ranges between the cut-off time point of the second switch and the cut-off time point of the horizontal scan period.

6. The display panel as claimed in claim 1, wherein the first switch is coupled to a first terminal of the first source line, the first compensation capacitor is coupled to a second terminal of the first source line, the second switch is coupled to a first terminal of the second source line, and the second compensation capacitor is coupled to a second terminal of the second source line.

7. The display panel as claimed in claim 1, wherein each of the first subpixels and the second subpixels comprises:

a first transistor, having a source terminal coupled to a first voltage, a gate terminal, and a drain terminal;

a first capacitor, coupled between a second voltage and the gate terminal of the first transistor;

a second transistor, having a source terminal coupled to the drain terminal of the first transistor, a gate terminal receiving a scan signal, and a drain terminal coupled to the gate terminal of the first transistor;

a third transistor, having a source terminal coupled to the drain terminal of the first transistor, a gate terminal receiving a light emitting signal, and a drain terminal; and an organic light emitting diode, coupled between the drain terminal of the third transistor and a common voltage;

wherein one of the first voltage and the second voltage is a data voltage transmitted by the first source line or the second source line, and the other one of the first voltage and the second voltage is a system voltage different from the common voltage.

8. The display panel as claimed in claim 1, wherein the reference voltage is a common voltage.

9. The display panel as claimed in claim 1, wherein the source driver is disposed on a circuit board coupled to the display panel.

* * * * *